US009764456B2

(12) United States Patent
Li

(10) Patent No.: US 9,764,456 B2
(45) Date of Patent: Sep. 19, 2017

(54) PNEUMATIC NAIL GUN

(71) Applicant: Xiao-Rong Li, Taizhou (CN)

(72) Inventor: Xiao-Rong Li, Taizhou (CN)

(73) Assignee: ZHEJIANG RONGPENG AIR TOOLS CO., LTD., Taizhou, Zhejiang (CN)

( * ) Notice: Subject to any disclaimer, the term of this patent is extended or adjusted under 35 U.S.C. 154(b) by 589 days.

(21) Appl. No.: 14/333,527

(22) Filed: Jul. 17, 2014

(65) Prior Publication Data

US 2015/0197001 A1 Jul. 16, 2015

(30) Foreign Application Priority Data

Jan. 10, 2014 (CN) ..... 2014 1 0011169

(51) Int. Cl.
*B25C 1/04* (2006.01)

(52) U.S. Cl.
CPC ..... *B25C 1/042* (2013.01); *B25C 1/047* (2013.01)

(58) Field of Classification Search
CPC ..... B25C 1/042; B25C 1/047
USPC ..... 227/119–139; 173/90, 171, 213
See application file for complete search history.

(56) References Cited

U.S. PATENT DOCUMENTS 2,944,522 A * 7/1960 Doyle ..... B25C 1/044 173/127
3,086,207 A * 4/1963 Lingle ..... B25C 1/005 227/123
3,152,519 A * 10/1964 Doyle ..... B25C 1/045 173/169
3,434,643 A * 3/1969 Wandel ..... B25C 1/044 227/130
3,605,559 A * 9/1971 Korth ..... B27F 7/34 227/130
3,850,079 A * 11/1974 Fehrs ..... B25C 1/044 227/130
3,871,566 A * 3/1975 Elliesen ..... B25C 1/042 227/130
4,030,655 A * 6/1977 Rothfuss ..... B25C 1/044 227/130
4,040,554 A * 8/1977 Haytayan ..... B25C 1/008 227/130
4,280,248 A * 7/1981 Herubel ..... A22B 3/02 124/40

(Continued)

*Primary Examiner* — Gloria R Weeks
*Assistant Examiner* — Lucas Palmer

(57) ABSTRACT

The present invention discloses a pneumatic nail gun, which comprises a nail tool body, a cylinder seat arranged above the nail tool body, a housing cap arranged at top end of the cylinder seat; a seal gasket is arranged inside top of the housing cap; a head valve is arranged inside the housing cap, and a spring is disposed inside the head valve; a collar is actively arranged inside the cylinder seat, a cylinder being disposed inside the cavity of the tool body; the collar can move reciprocally along a space formed between the cylinder seat and the inner step surface of the cylinder; a control valve assembly is arranged along a radical direction of the cylinder seat; a piston driver assembly is actively arranged inside a chamber being formed by an inner hole of the collar and an inner hole of the cylinder. The pneumatic nail gun can reduce the pressure oscillation when firing, increase the effectiveness of the firing for every time.

7 Claims, 9 Drawing Sheets

(56) References Cited

U.S. PATENT DOCUMENTS 4,313,552 A * 2/1982 Maurer ..... B25C 1/005 227/109
4,351,464 A * 9/1982 Fehrs ..... B25C 1/008 227/132
4,380,313 A * 4/1983 Klaus ..... B25C 1/041 227/130
4,593,846 A * 6/1986 Evertz ..... B25C 1/047 227/130
4,811,882 A * 3/1989 Steeves ..... B25C 1/043 227/130
5,020,712 A * 6/1991 Monacelli ..... B25C 1/041 227/120
5,131,579 A * 7/1992 Okushima ..... B25C 1/044 173/210
5,135,152 A * 8/1992 Uno ..... B25C 1/005 227/116
5,441,192 A * 8/1995 Sugita ..... B25C 1/047 173/211
5,873,510 A * 2/1999 Hirai ..... B25C 1/043 227/130
5,878,936 A * 3/1999 Adachi ..... B25C 1/041 227/130
6,145,727 A * 11/2000 Mukoyama ..... B25C 1/044 227/130
7,677,426 B2 * 3/2010 Tillinghast ..... B25C 1/043 227/10
7,712,647 B2 * 5/2010 Tanji ..... B25C 1/041 227/109
8,091,751 B2 * 1/2012 Tanaka ..... B25C 1/008 227/10
8,746,527 B2 * 6/2014 Laubach ..... B25C 1/044 227/130
2004/0238590 A1 * 12/2004 Ishizawa ..... B25C 1/046 227/130
2005/0001007 A1 * 1/2005 Butzen ..... B25C 1/005 227/130
2008/0006670 A1 * 1/2008 Wen ..... B25C 1/045 227/130
2008/0023519 A1 * 1/2008 Aihara ..... B25C 1/042 227/130
2010/0230461 A1 * 9/2010 Tanaka ..... B25C 1/08 227/9
2011/0114692 A1 * 5/2011 Liang ..... B25C 1/04 227/2
2011/0180581 A1 * 7/2011 Liang ..... B25C 1/047 227/8
2011/0192879 A1 * 8/2011 Zhang ..... B25C 1/041 227/156
2011/0198380 A1 * 8/2011 Kitagawa ..... B25C 1/041 227/2
2011/0198384 A1 * 8/2011 Kitagawa ..... B25C 1/041 227/130
2011/0290850 A1 * 12/2011 Wu ..... B25C 1/04 227/130
2012/0138328 A1 * 6/2012 Teipel ..... B25D 9/12 173/207

* cited by examiner

PNEUMATIC NAIL GUN

FIELD OF THE INVENTION

The present invention relates to a pneumatic tool, especially to a pneumatic nail gun.

BACKGROUND OF THE INVENTION

Pneumatic nail gun of prior art have bigger pressure oscillation, so there's no guarantee that the effectiveness of the fired nails.

SUMMARY OF INVENTION

From this, the invention intends to provide a pneumatic nail gun, which can reduce the pressure oscillation when firing, increase the effectiveness of the firing for every time.

The technical problem to be solved by the utility model is to overcome defects of the prior art, which is a pneumatic nail gun is characterized by comprising a nail tool body (31), which includes a vertical barrel, a cavity (311) arranged inside the barrel, a handle arranged at one end of the barrel; the handle is provided with an end cap (42) and an air hose fitting (44) connecting with the end cap (42), a compressed air being passed from the air hose fitting (44) to the cavity (311) of the barrel through the handle;

a cylinder seat (16) is arranged on top of the barrel, a housing cap (5) being arranged on top of the cylinder seat (16); an exhaust cover (3) is disposed at a top opening of the housing cap (5); a seal gasket (6) is arranged inside top of the housing cap (5);

a head valve (12) is arranged inside the housing cap (5), and a spring (11) is disposed inside the head valve (12); the head valve (12) is arranged actively inside a valve passage formed by housing cap (5); the head valve (12) can move reciprocally along the valve passage in the housing cap (5); an inner O-ring (13) and an outer O-ring (14) are respectively arranged at the bottom end of the head valve (12);

a collar (27) is actively arranged inside the cylinder seat (16), a cylinder (30) being disposed inside the cavity (311) of the tool body (31); an inner step surface is arranged at top of the cylinder (30), which is used to limit the collar (27) the lowest position; the collar (27) can move reciprocally along a space formed between the cylinder seat (16) and the inner step surface of the cylinder (30);

a control valve assembly (161) is arranged along a radical direction of the cylinder seat (16); the control valve assembly (161) comprises a control valve body (22), the control valve body (22) can be moved in an inner hole arranged in the radical direction of the cylinder seat (16); a groove is disposed in outer wall of the collar (27), which is matched with a head part of the control valve body (22);

the groove of the collar (27) is on the head part of the control valve body (22) while the collar (27) is moved at the highest position, at this point the control valve can be moved to the left; the control valve body (22) is at the leftmost position while the head part of the control valve body (22) enters into the groove of the collar (27), at this point the left air path is been closed by the control valve body (22);

a piston driver assembly (28) is actively arranged inside a chamber which is formed by an inner hole of the collar (27) and an inner hole of the cylinder (30); the piston driver assembly (28) can move reciprocally along the inner wall of the collar (27) and cylinder (30);

a nose assembly (38) is connected fixedly a bottom of the barrel; a guide block (34) is arranged at the top of the nose assembly (38), a piston stem of the piston driver assembly (28) is actively arranged inside an inner hole of the guide block (34); when the piston driver assembly (28) is moving reciprocally along the inner wall of the collar (27) and cylinder (30), the piston stem of the piston driver assembly (28) is moving reciprocally along the inner hole of the guide block (34) simultaneously;

a chamber is formed between the nose assembly (38) and the guide block (34), in which an exhaust sleeve (36) is actively arranged, the guide block (34) being connected with the exhaust sleeve (36) through a spring (361); the exhaust sleeve (36) can be moved reciprocally inside the chamber; a exhaust hole (362) is arranged on the nose assembly (38), the reciprocal movement of the exhaust sleeve (36) can control the exhaust hole opened and closed, so as to realize that an lower part of the cylinder (30) is communicated with outside air through the nose assembly (38);

an exhaust passage is arranged inside the nose assembly (38); one end of the exhaust passage is communicated with the bottom of the left air passage of barrel; the other end of the exhaust passage is communicated with a chamber formed between the nose assembly (38) and the guide block (34);

both a left air passage of barrel and a right air passage of barrel are arranged inside the barrel in vertical direction; a trigger assembly is arranged between the right air passage of barrel and a passage connected with outside air, which is used to control the communication between the right air passage of barrel and the outside air;

both a left air passage and a right air passage are arranged inside the cylinder seat (16); a bottom of the right air passage of the cylinder seat (16) is communicated with a top of the right air passage of barrel, the left air passage of the cylinder seat (16) is communicated with a top of the left air passage of barrel; left pneumatic passage is formed by the left air passage of the cylinder seat (16) and the left air passage of barrel, while right pneumatic passage is formed by the right air passage of the cylinder seat (16) and the right air passage of barrel; the control valve assembly (161) of the cylinder seat (16) is used to control the left pneumatic passage opened and closed; when a pressure toward the right bigger than the left in the control valve assembly (161), the control valve body (22) moves to the left, and the left pneumatic passage is closed and vice versa; when the left pneumatic is opened, a cavity arranged at the bottom of the head valve (12) is communicated therebetween;

an air passage of housing cap is arranged inside the housing cap (5), one end of the air passage of housing cap is communicated with a top of valve passage of the housing cap (5), the other end of the air passage of housing cap is communicated with the top of the right air passage of the cylinder seat (16).

the trigger assembly comprises a trigger valve head (56), a valve seat (46) connected fixedly with a top of the trigger valve head (56), a valve sleeve (50) arranged actively inside the valve seat (46), a plunger (53) connected with the valve sleeve (50) through a trigger spring (52); a is formed among the plunger (53), the valve sleeve (50) and the trigger valve head (56); The plunger (53) extends out from the trigger valve head (56); an air passage of trigger valve head is formed inside the trigger valve head (56) in vertical direction; reciprocating movement of the plunger (53) can control the communication between the air passage of trigger valve head and the closed space of trigger valve head;

a bumper (32) is arranged at the bottom of the cylinder (30), which is used to reduce the impact force of the movement on the piston driver assembly (28); the bumper (32) is arranged on a top of the nose assembly (38), a resilient washer (33) is arranged at top of the guide block (34), which is used for axial position between the guide block (34) and the nose assembly (38), the collar (27) is at the highest position in the beginning of operation; a compressed air enters from the air hose fitting (44) into the nail tool body (31) through the trigger assembly in an enabled state, the right air passage of the cylinder seat (16) and the air passage of the housing cap (5), and proceeds to the top of the valve passage [which is a cavity arranged at the top of the head valve (12)], which causes the head valve (12) moving downward until the outer O-ring (14) connected with the cylinder seat (16), thereby forming a seal with a top end of the cylinder seat (16);

as the compressed air enters the cavity (311) of the tool body (31), the pressure toward the right bigger than the left in the control valve assembly (161), the control valve body (22) moves to the left, the head part of the control valve body (22) inserted into the groove of the collar (27), and formed a seal with a tilted surface of the cylinder seat (16), so that the left pneumatic passage is closed.

the plunger (53) moves downward, which drives the valve sleeve (50) to compress air disposed inside a closed space of the trigger valve head for higher air pressure, and cause the valve sleeve (50) is being pushed up, so that an air passage of the head valve (12) [which is an air passage through the right air passage of barrel, the right air passage of the cylinder seat (16), the air passage of housing cap and the top cavity of the head valve (12)] is communicated with the air passage of trigger valve head; at this point, the only one pressure toward the right for the control valve assembly (161), so the control valve body (22) moves to the right, which caused the left pneumatic passage is opened;

as the compressed air arranged inside the cavity (311) of the tool body (31) enter into a bottom cavity of the head valve (12) through the left air passage of barrel and the left air passage of cylinder seat, the head valve (12) moves upward until the top side of the head valve (12) connects with the seal gasket (6) of the housing cap (5) for seal; at this point, the head valve (12) is separated from the cylinder seat (16), which caused the air passage of the chamber in the inner hole of the cylinder (30) opened;

as the compressed air enters from the piston driver assembly (28) into chamber of the cylinder (30), the piston driver assembly (28) moves down under the pressure, until piston seat connected with bumper (32); at this point, the collar (27) also moves down under differential pressure until collar (27) connected with the inner step of the cylinder (30), where the collar (27) is at lowest position.

air passage of the head valve (12) is being closed from outside air while the head valve (12) get back from being pressed position, the compressed air entered into the top chamber of head valve (12) from air passage of the head valve (12), which caused the head valve (12) moved downward until seal with the top of the cylinder seat (16);

at this point, as the collar (27) is still at the lowest position, the head part of the control valve body (22) cannot enter into the groove of the collar (27), so the control valve body (22) cannot move to the leftmost position for keeping clear of the left pneumatic passage; while the compressed air from air passage of the head valve (12) enters the top cavity of the head valve (12), the compressed air from the left air passage of cylinder seat (16) moves down to lower part of the piston driver assembly (28) through left air passage of barrel, proceeds to exhaust passage of the nose assembly (38), and enters into chamber of the nose assembly (38); the piston driver assembly (28) moves upward being driven by the compressed air moved below piston seat of the piston driver assembly (28); the compressed air moving into the chamber of the nose assembly (38) pushes up the exhaust sleeve (36) for closed the exhaust hole (362), so as to close the passage arranged in lower part of the cylinder (30) being communicated with outside air through the nose assembly (38);

as the piston driver assembly (28) moves upward to connect with the collar (27), which is driven by the compressed air, the collar moves up simultaneously;

as the collar (37) moves to the highest position, the control valve body (22) can move to the left, until the head part of the valve body (22) enters into the groove of the collar (27) for closed the left pneumatic passage; at this point, both the piston driver assembly (28) and the collar (27) are returned to original position;

as the left pneumatic passage is closed, the compressed air into chamber of the nose assembly is being blocked, the exhaust sleeve (36) moves downward by spring (361) for closed exhaust hole (362), so as to open the passage arranged in lower part of the cylinder (30) being communicated with outside air through the nose assembly (38) for exhausted the compressed air arranged in the chamber of the cylinder (30), thus, one cycle of operation is completed.

Compared with the prior art, the utility model has the beneficial effects are that:

The present invention changed two chambers of pneumatic nail gun of the prior art to one chamber; the chamber being used for returned of the original position changes for working, which can effectively increase air saving space of product without increasing its weight and size, so as to decrease pressure oscillation in use and increase the effectiveness of the firing for every time.

The invention will now be described in connection with certain preferred embodiments with reference to the following illustrative figures so that it may be more fully understood.

DETAILED DESCRIPTION OF THE PREFERRED EMBODIMENTS

Figure 1:
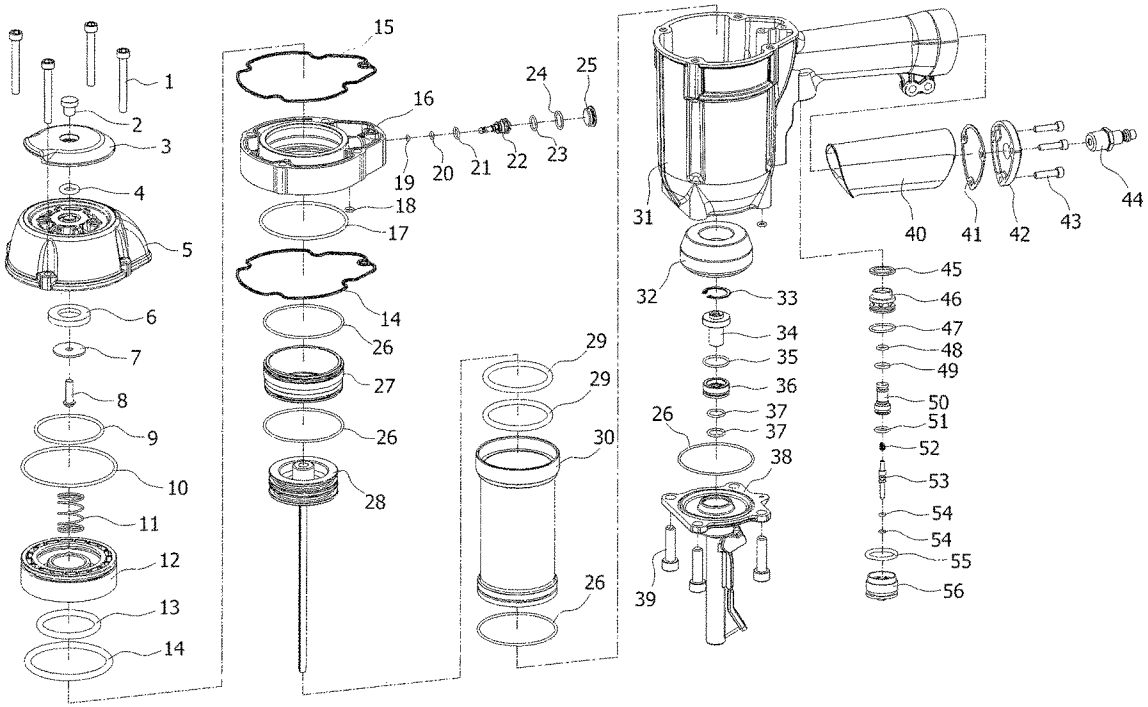
FIG. 1 is an exploded view in the present invention.

A pneumatic nail gun as shown in FIG. 1 comprises a nail tool body (31), which includes a vertical barrel, a cavity (311) arranged inside the barrel, a handle arranged at one end of the barrel; the handle is provided with a protecting jacket (40), an end cap (42), an air hose fitting (44) connecting with the end cap (42) by a plurality of bolts (43); a gasket (41) arranged between the end cap (42) and one end of the handle; a compressed air being passed from the air hose fitting (44) to the cavity (311) of the barrel through the handle;

A cylinder seat (16) is arranged on top of the barrel and an O-ring arranged below the cylinder seat (17); and a housing cap (5) is fixed on top of the cylinder seat (16) by a plurality of bolt (1); an exhaust cover (3) is disposed at a top opening of the housing cap (5), and fixed each other by a bolt (8), a washer (7), an exhaust bolt (2); an O-ring (4) disposed between the exhaust cover (3) and the housing cap (5); a seal gasket (6) is arranged inside top of the housing cap (5);

A seal ring (15) is disposed between the cylinder seat (16) and the housing cap (5); the seal ring (15) is disposed between the cylinder seat (16) and the top surface of the barrel;

A head valve (12) is arranged inside the housing cap (5), and a spring (11) is disposed inside the head valve (12); the head valve (12) is arranged actively inside a valve passage formed by housing cap (5), an O-ring (9, 10) respectively arranged between both inside and outside of the head valve (12) and both inner and outer wall of the valve passage of the housing cap (5); the head valve (12) can move reciprocally along the valve passage in the housing cap (5); an inner O-ring (13) and an outer O-ring (14) are respectively arranged at the bottom end of the head valve (12); the inner O-ring (13) is used to reduce impact force of a piston driver assembly (28) on the head valve (12), while the outer O-ring (14) is used to seal between one end surface of the head valve (12) and the cylinder seat (16);

A collar (27) is actively arranged inside the cylinder seat (16), a cylinder (30) being disposed inside the cavity (311) of the tool body (31); an inner step surface is arranged at top of the cylinder (30), which is used to limit the collar (27) the lowest position; the collar (27) can move reciprocally along a space formed between the cylinder seat (16) and the inner step surface of the cylinder (30); the collar (27) is provided with two seal rings (26) in outer wall, which is used for sealing between the collar (27) and cylinder seat (16), and between the collar (27) and the cylinder (30);

An inner diameter of the collar (27) is the same as the one of the cylinder (30); an piston driver assembly (28) is actively arranged inside a chamber which is formed by an inner hole of the collar (27) and an inner hole of the cylinder (30); the piston driver assembly (28) can move reciprocally along the inner wall of the collar (27) and cylinder (30); the piston driver assembly (28) is provided with two seal rings (29), which is used for sealing between a piston and the collar (27), and between the piston and the cylinder (30); a bumper (32) is arranged at the bottom of the cylinder (30), which is used to reduce the impact force of the movement on the piston driver assembly (28);

Both the bottom of the cylinder (30) and the cavity (311) of the tool body (31) are sealed through the seal ring (26);

A control valve assembly (161) is arranged along a radical direction of the cylinder seat (16), which is used to control a left pneumatic passage opened and closed (right pneumatic passage keeps opened), so as to control the orientation of the air flow; the control valve assembly (161) comprises a control valve body (22), a plurality of O-rings (19, 20, 21, 23) being arranged in an outer edge of the control valve body (22) and being used to seal with an inner hole of the cylinder seat (16) therebetween; a seal head (25) is arranged at one end of the control valve body (22), which is sealed with the inner hole of the cylinder seat (16) by an O-ring (24);

The control valve body (22) can be moved in the inner hole arranged in the radical direction of the cylinder seat (16); a groove is disposed in outer wall of the collar (27), which is matched with a head part of the control valve body (22); the groove of the collar (27) is on the head part of the control valve body (22) while the collar (27) is moved at the highest position, at this point the control valve can be moved to the left; the control valve body (22) is at the leftmost position while the head part of the control valve body (22) enters into the groove of the collar (27), at this point the left pneumatic passage is been closed by the control valve body (22);

A nose assembly (38) is connected fixedly a bottom of the barrel by a plurality of bolts (39); the bumper (32) is arranged on a top of the nose assembly (38);

A guide block (34) is arranged at the top of the nose assembly (38), a piston stem of the piston driver assembly (28) is actively arranged inside an inner hole of the guide block (34); when the piston driver assembly (28) is moving reciprocally along the inner wall of the collar (27) and cylinder (30), the piston stem of the piston driver assembly (28) is moving reciprocally along the inner hole of the guide block (34) simultaneously until a lower surface of the piston driver assembly (28) is reached to an top surface of the bumper (32), at this point one end of the piston stem is reached out from an inner hole of the nose assembly (38);

A resilient washer (33) is arranged at top of the guide block (34), which is used for axial position between the guide block (34) and the nose assembly (38);

A chamber is formed between the nose assembly (38) and the guide block, in which an exhaust sleeve (36) is actively arranged, the guide block (34) being connected with the exhaust sleeve (36) through a spring (361); the exhaust sleeve (36) can be moved reciprocally inside the chamber; an outer wall of the exhaust sleeve (36) is sealed with the inner hole of the nose assembly (38) by an O-ring (37); an inner diameter of the exhaust sleeve (36) is sealed with an outer wall of the guide block (34) by an O-ring (37); a exhaust hole (362) is arranged on the nose assembly (38), the reciprocal movement of the exhaust sleeve (36) can control the exhaust hole opened and closed, so as to realize that an lower part of the cylinder (30) is communicated with outside air through the nose assembly (38);

Both a left air passage of barrel and a right air passage of barrel are arranged inside the barrel in vertical direction; a trigger assembly is arranged between the right air passage of barrel and a passage connected with outside air, which is used to control the communication between the right air passage of barrel and the outside air;

The trigger assembly comprises a trigger valve head (56), a valve seat (46) connected fixedly with a top of the trigger valve head (56), a valve sleeve (50) arranged actively inside the valve seat (46), a plunger (53) connected with the valve sleeve (50) through a trigger spring (52); a is formed among the plunger (53), the valve sleeve (50) and the trigger valve head (56);

The plunger (53) extends out from the trigger valve head (56); an air passage of trigger valve head is formed inside the trigger valve head (56) in vertical direction; reciprocating movement of the plunger (53) can control the communication between the air passage of trigger valve head and the closed space of trigger valve head;

The trigger valve head (56), the tool body (31) and the valve seat (46) connected fixedly; the inner hole between trigger valve head (56) and tool body (31) are sealed through an O-ring (47); the inner hole between valve sleeve (50) and tool body (31) are sealed through an O-ring (48); both the valve sleeve (50) and the valve seat (46) are sealed through an O-ring (49); both the valve sleeve (50) and the trigger valve head (56) are sealed through an O-ring (51); both the plunger (53) and the trigger valve head (56) are sealed through an O-ring (54);

An exhaust passage is arranged inside the nose assembly (38); one end of the exhaust passage is communicated with the bottom of the left air passage of barrel, a connection part of the exhaust passage is provided with an O-ring (18); the other end of the exhaust passage is communicated with a chamber formed between the nose assembly (38) and the guide block (34);

Both a left air passage and a right air passage are arranged inside the cylinder seat (16); a bottom of the right air passage of the cylinder seat (16) is communicated with a top of the right air passage of barrel, the left air passage of the cylinder seat (16) is communicated with a top of the left air passage of barrel; left pneumatic passage is formed by the left air passage of the cylinder seat (16) and the left air passage of barrel, while right pneumatic passage is formed by the right air passage of the cylinder seat (16) and the right air passage of barrel; the control valve assembly (161) of the cylinder seat (16) is used to control the left pneumatic passage opened and closed; when a pressure toward the right bigger than the left in the control valve assembly (161), the control valve body (22) moves to the left, and the left pneumatic passage is closed and vice versa; when the left pneumatic is opened, a cavity arranged at the bottom of the head valve (12) is communicated therebetween;

An air passage of housing cap is arranged inside the housing cap (5), one end of the air passage of housing cap is communicated with a top of valve passage of the housing cap (5), the other end of the air passage of housing cap is communicated with the top of the right air passage of the cylinder seat (16).

Figure 2:
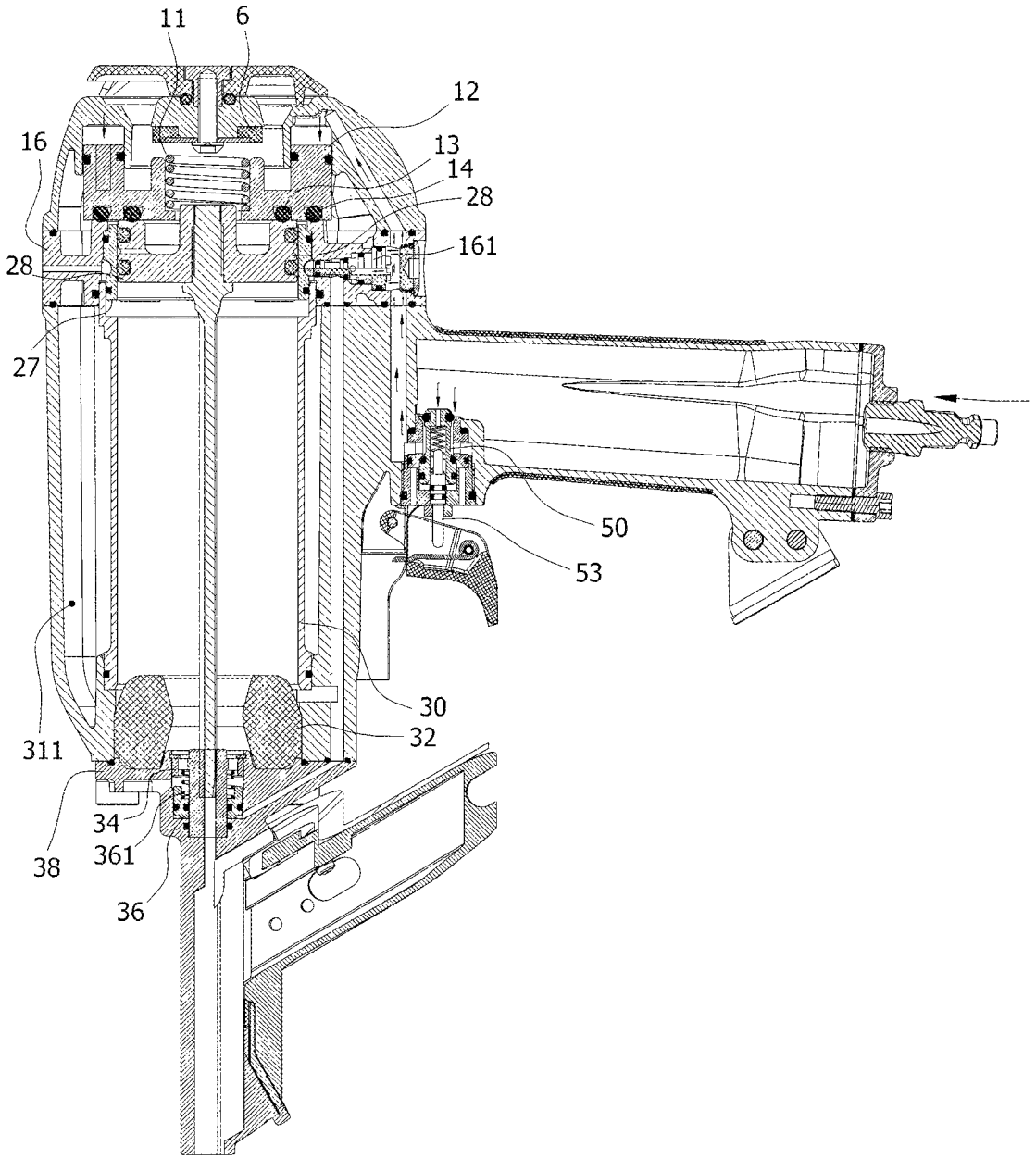
FIG. 2 is schematic view showing the beginning of operation in the present invention.

Operation principle of the present invention is as follow:

In the beginning of operation, the collar (27) is at the highest position as shown in FIG. 2; a compressed air enters from the air hose fitting (44) into the nail tool body (31) through the trigger assembly in an enabled state, the right air passage of the cylinder seat (16) and the air passage of the housing cap (5), and proceeds to the top of the valve passage [which is a cavity arranged at the top of the head valve (12)], which causes the head valve (12) moving downward until the outer O-ring (14) connected with the cylinder seat (16), thereby forming a seal with a top end of the cylinder seat (16);

As the compressed air enters the cavity (311) of the tool body (31), the pressure toward the right bigger than the left in the control valve assembly (161), the control valve body (22) moves to the left, the head part of the control valve body (22) inserted into the groove of the collar (27), and formed a seal with a tilted surface of the cylinder seat (16), so that the left pneumatic passage is closed.

Figure 3:
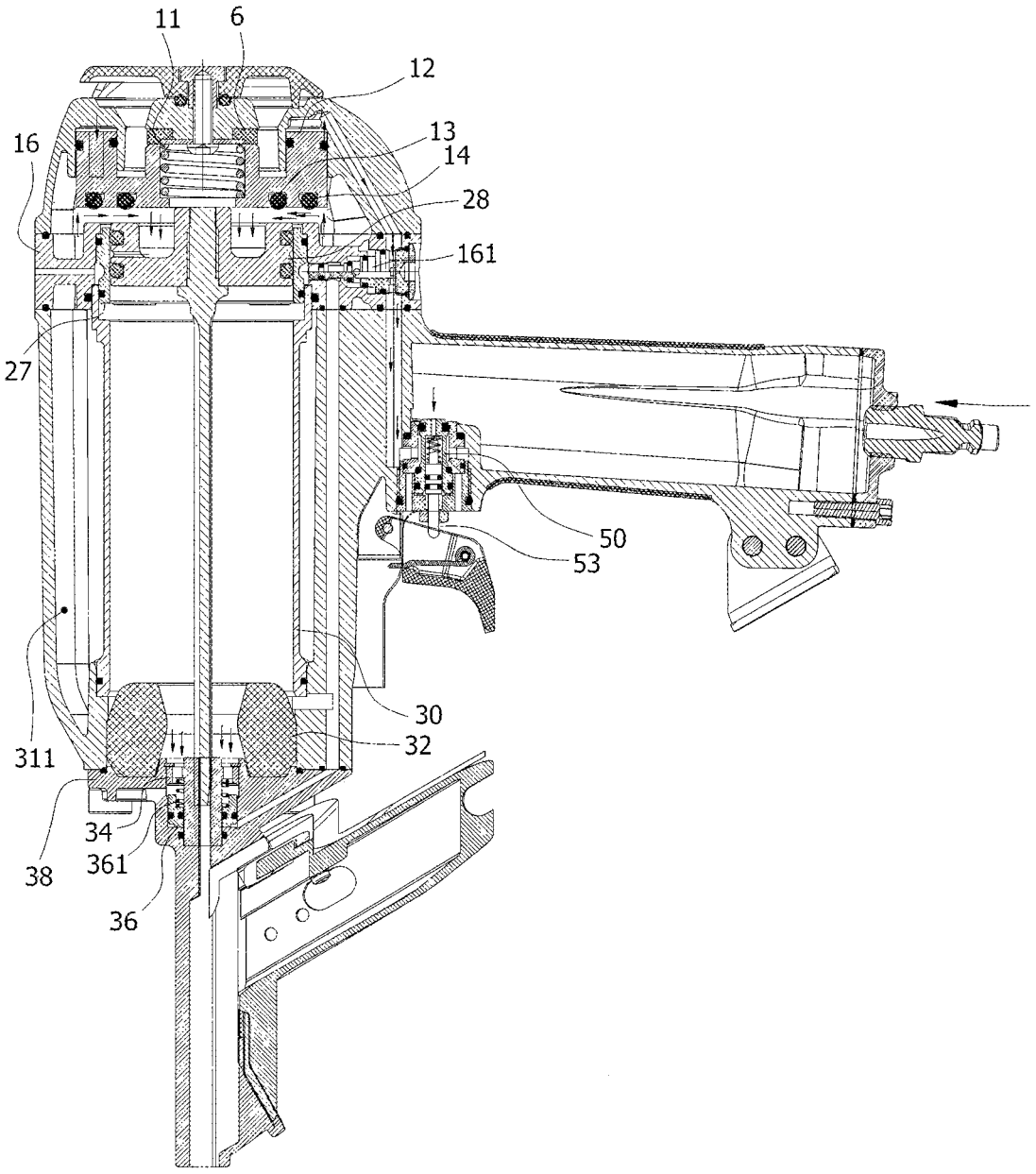
FIG. 3 and FIG. 4 are schematic views showing the state of pulling trigger in the present invention.
Figure 4:
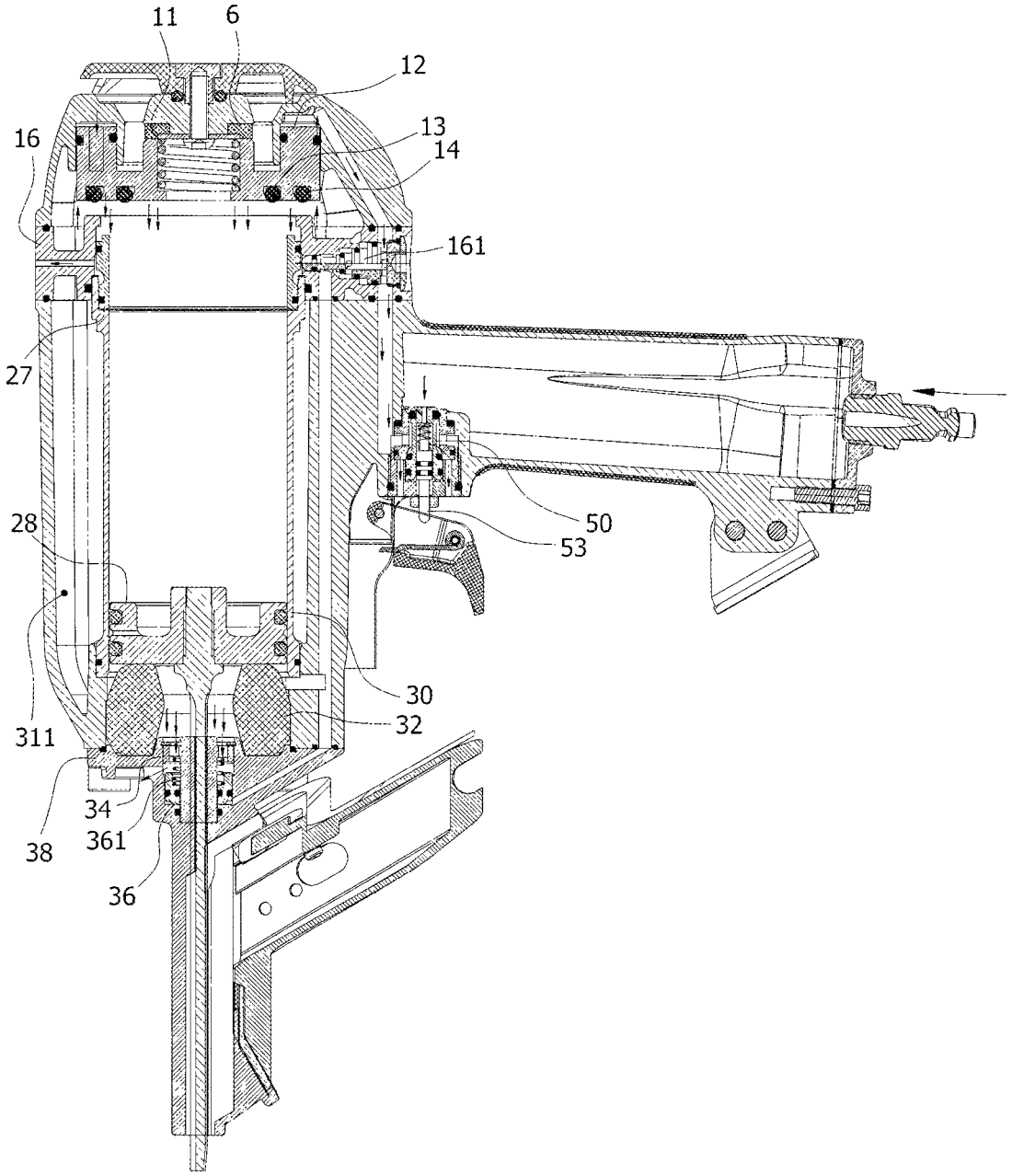

As shown in FIG. 3, the plunger (53) moves downward, which drives the valve sleeve (50) to compress air disposed inside a closed space of the trigger valve head for higher air pressure, and cause the valve sleeve (50) is being pushed up, so that an air passage of the head valve (12) [which is an air passage through the right air passage of barrel, the right air passage of the cylinder seat (16), the air passage of housing cap and the top cavity of the head valve (12)] is communicated with the air passage of trigger valve head; at this point, the only one pressure toward the right for the control valve assembly (161), so the control valve body (22) moves to the right, which caused the left pneumatic passage is opened;

As the compressed air arranged inside the cavity (311) of the tool body (31) enter into a bottom cavity of the head valve (12) through the left air passage of barrel and the left air passage of cylinder seat, the head valve (12) moves upward until the top side of the head valve (12) connects with the seal gasket (6) of the housing cap (5) for seal; at this point, the head valve (12) is separated from the cylinder seat (16), which caused the air passage of the chamber in the inner hole of the cylinder (30) opened;

As shown in FIG. 4, as the compressed air enters from the piston driver assembly (28) into chamber of the cylinder (30), the piston driver assembly (28) moves down under the pressure, until piston seat connected with bumper (32); at this point, the collar (27) also moves down under differential pressure until collar (27) connected with the inner step of the cylinder (30), where the collar (27) is at lowest position;

A compressed air below the piston driver assembly (28) is being exhausted from the exhaust hole (362) during downward movement of the piston driver assembly (28).

Figure 5:
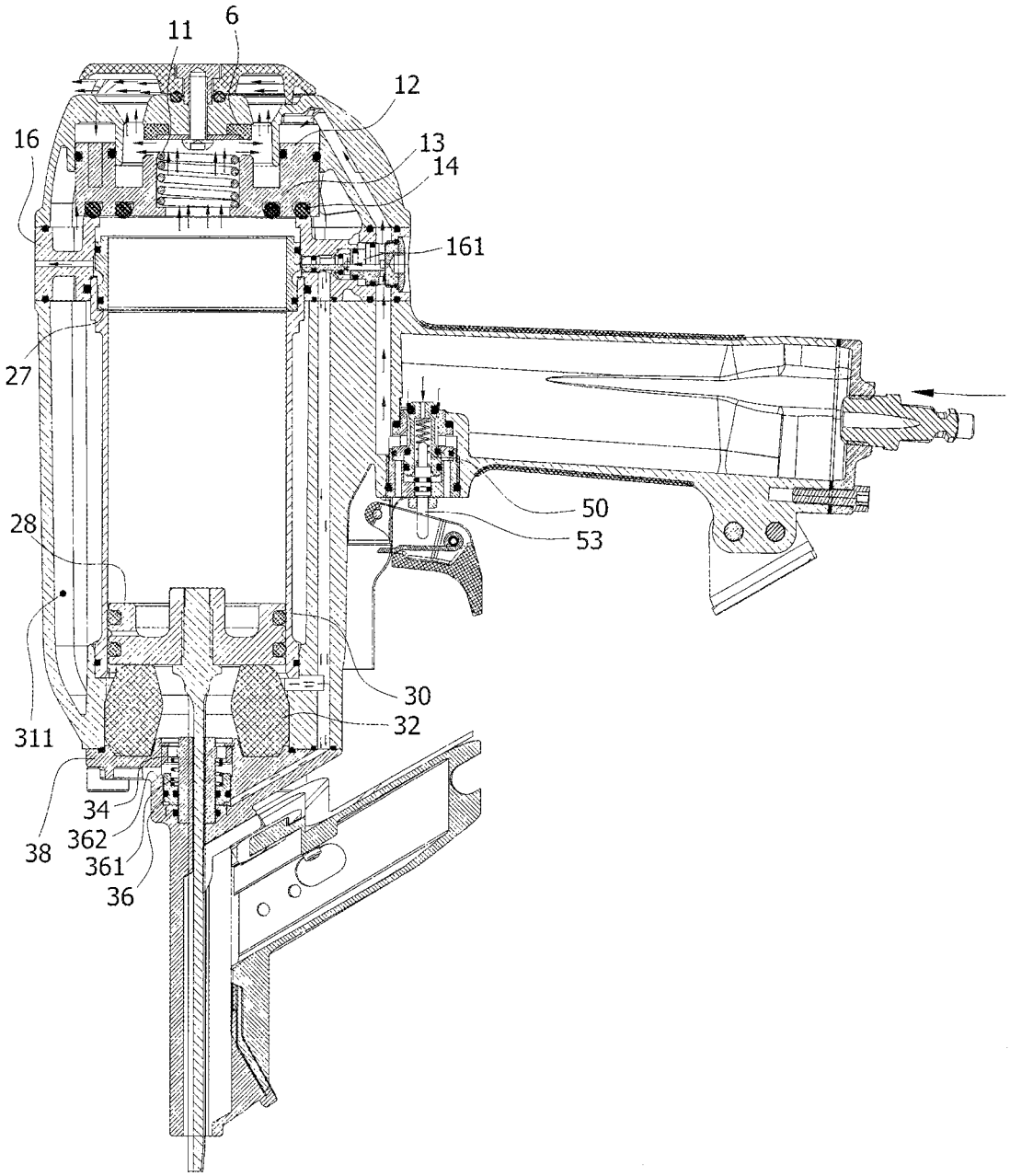
FIG. 5 to FIG. 9 are schematic views showing the state of releasing trigger in the present invention.
Figure 6:
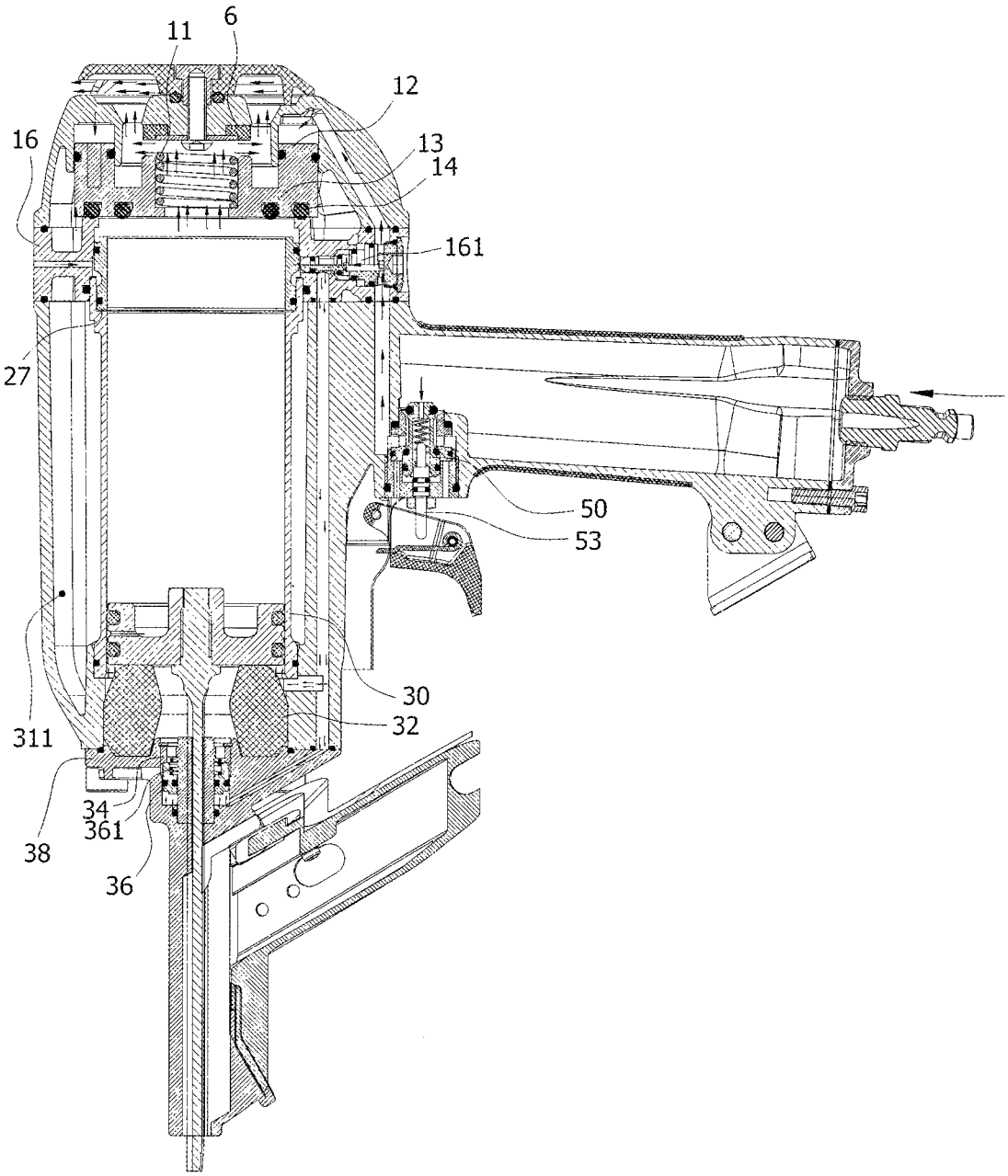
Figure 7:
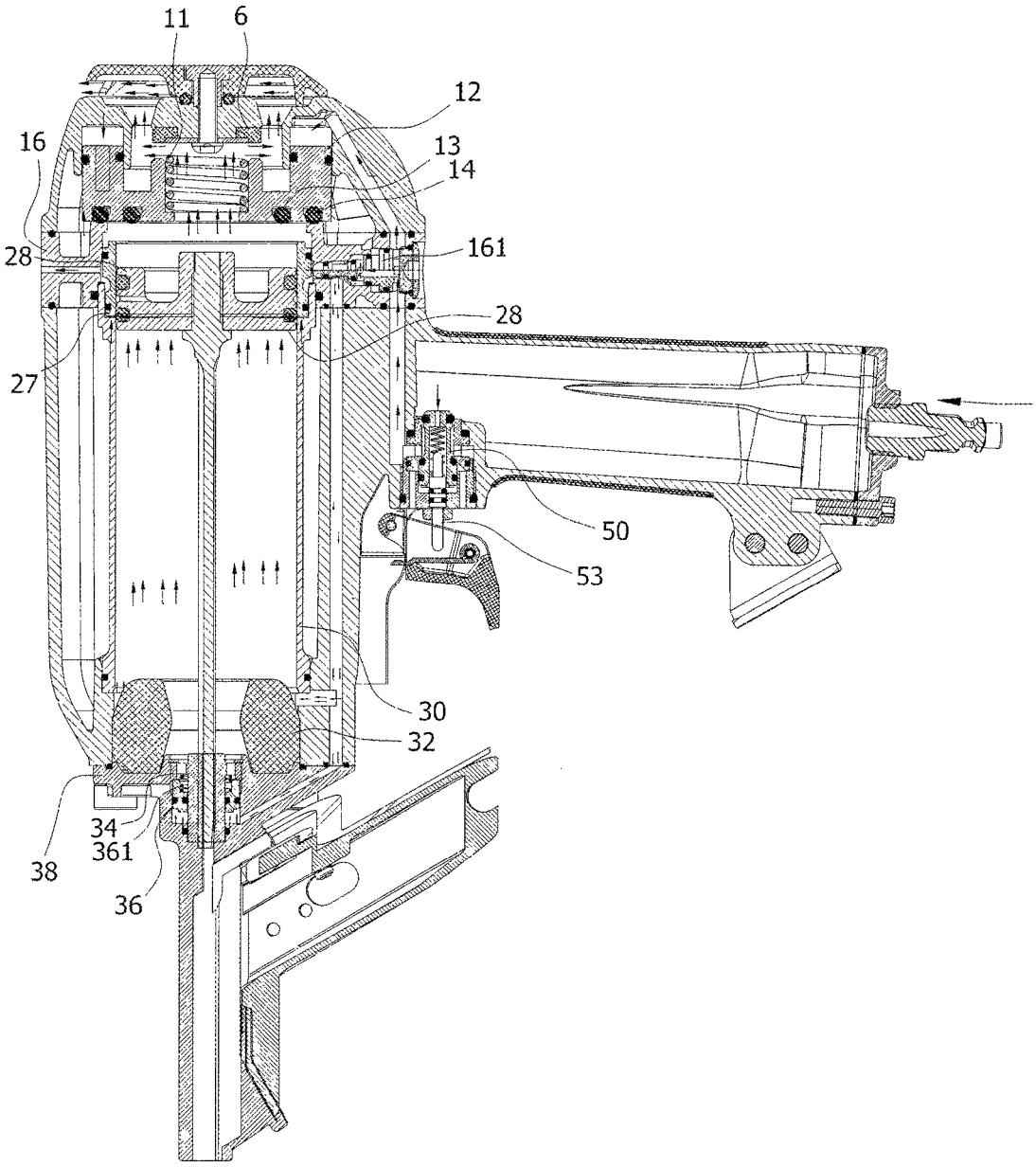
Figure 8:
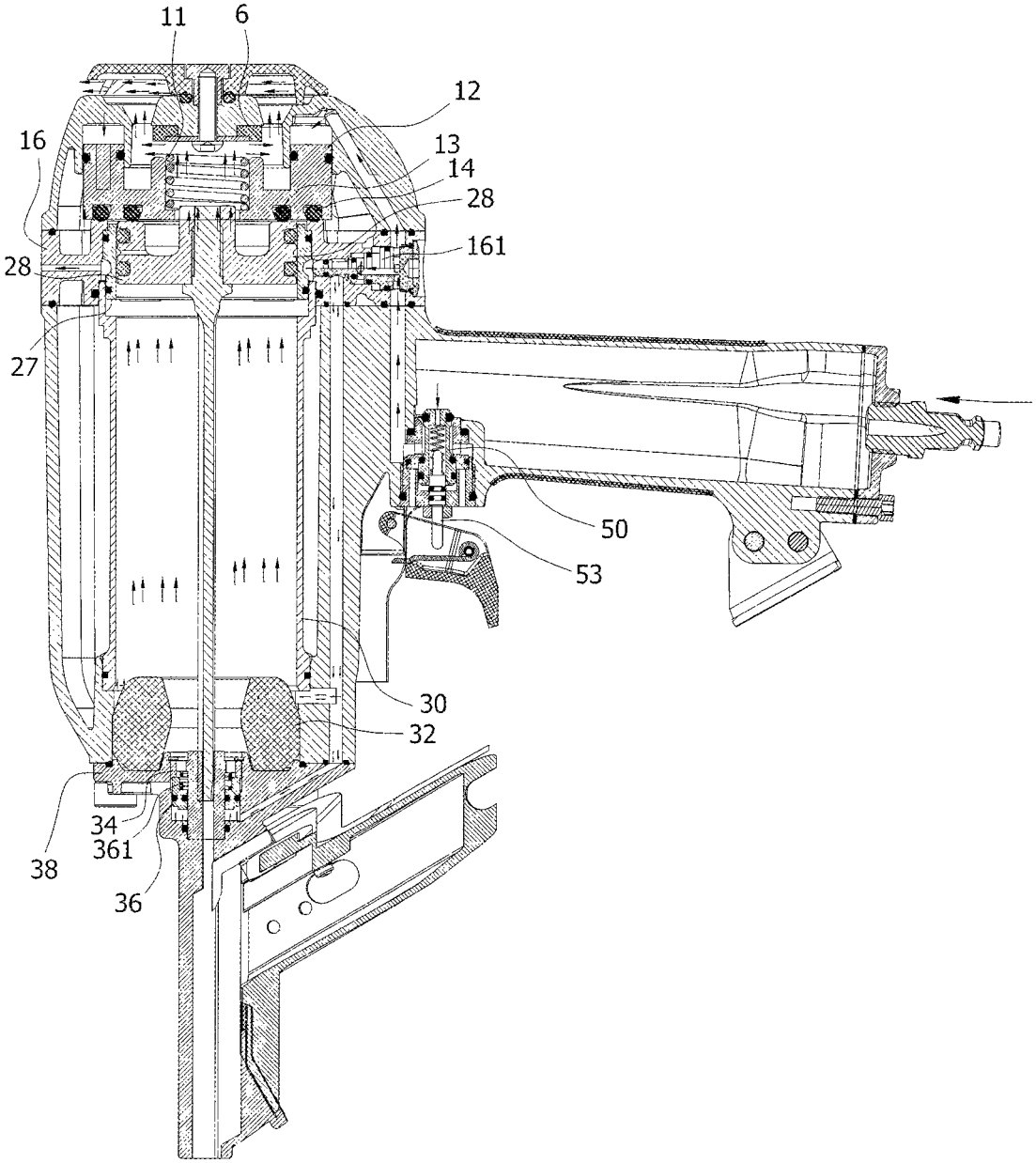
Figure 9:
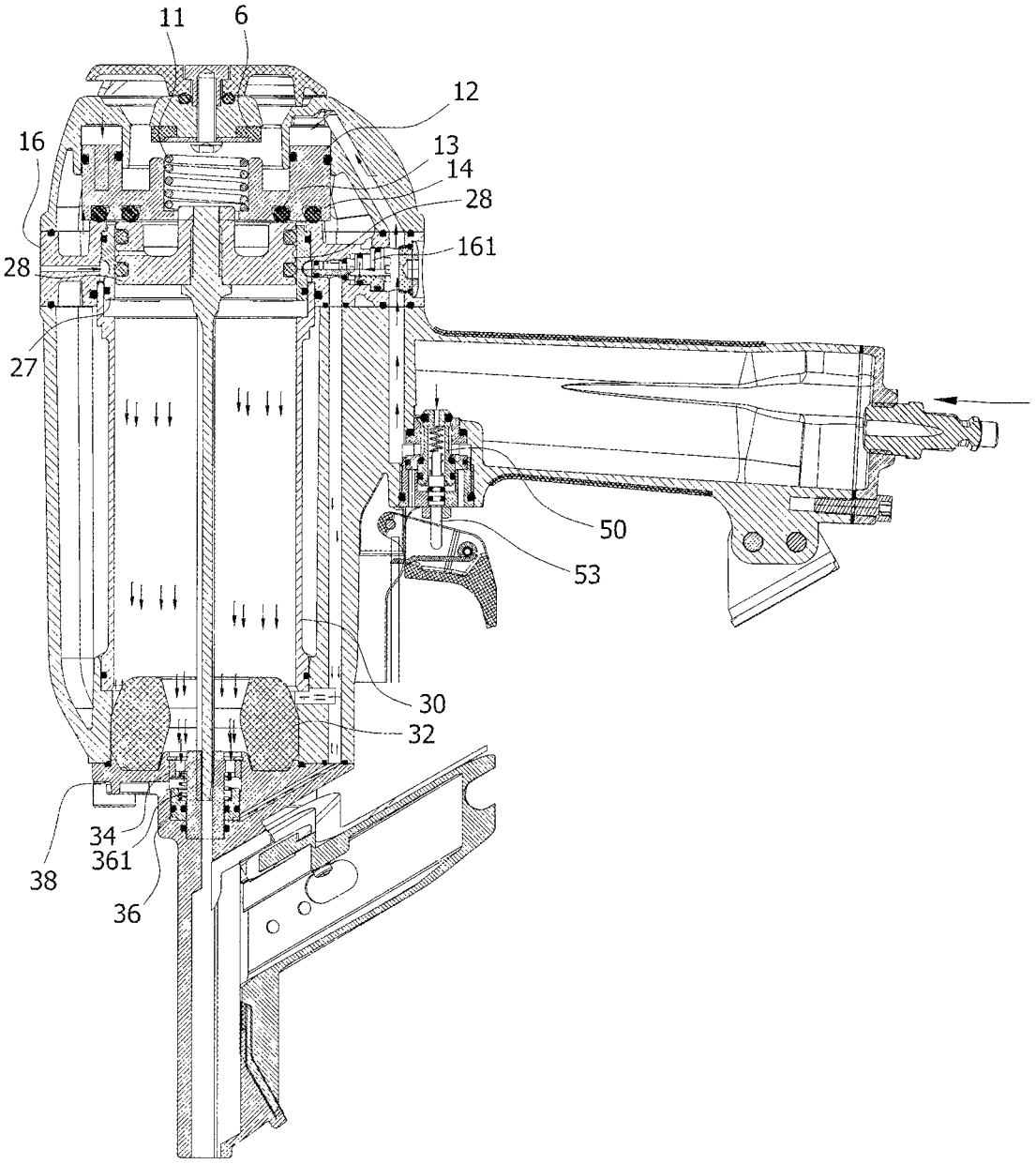

As shown in FIG. 5, air passage of the head valve (12) is being closed from outside air while the head valve (12) get back from being pressed position, the compressed air entered into the top chamber of head valve (12) from air passage of the head valve (12), which caused the head valve (12) moved downward until seal with the top of the cylinder seat (16);

At this point, as the collar (27) is still at the lowest position, the head part of the control valve body (22) cannot enter into the groove of the collar (27), so the control valve body (22) cannot move to the leftmost position for keeping clear of the left pneumatic passage; while the compressed air from air passage of the head valve (12) enters the top cavity of the head valve (12), the compressed air from the left air passage of cylinder seat (16) moves down to lower part of the piston driver assembly (28) through left air passage of barrel, proceeds to exhaust passage of the nose assembly (38), and enters into chamber of the nose assembly (38) as shown in FIG. 6; the piston driver assembly (28) moves upward being driven by the compressed air moved below piston seat of the piston driver assembly (28); the compressed air moving into the chamber of the nose assembly (38) pushes up the exhaust sleeve (36) for closed the exhaust hole (362), so as to close the passage arranged in lower part of the cylinder (30) being communicated with outside air through the nose assembly (38);

as the piston driver assembly (28) moves upward to connect with the collar (27), which is driven by the compressed air, the collar moves up simultaneously as shown in FIG. 7;

as the collar (37) moves to the highest position, the control valve body (22) can move to the left, until the head part of the valve body (22) enters into the groove of the collar (27) for closed the left pneumatic passage; at this point, both the piston driver assembly (28) and the collar (27) are returned to original position.

as shown in FIG. 9, as the left pneumatic passage is closed, the compressed air into chamber of the nose assembly is being blocked, the exhaust sleeve (36) moves downward by spring (361) for closed exhaust hole (362), so as to open the passage arranged in lower part of the cylinder (30) being communicated with outside air through the nose assembly (38) for exhausted the compressed air arranged in the chamber of the cylinder (30), thus, one cycle of operation is completed.

I claim:

1. A pneumatic nail gun, comprising:

a nail tool body (31) including a vertical barrel, a cavity (311) arranged inside the barrel, a handle arranged at one end of the barrel; the handle having an end cap (42) and an air hose fitting (44) connected with the end cap (42); a compressed air entering the cavity (311) of the barrel from the air hose fitting (44) through the handle;

a cylinder seat (16) being arranged on a top of the barrel, a housing cap (5) being arranged on a top of the cylinder seat (16); an exhaust cover (3) being disposed at a top opening of the housing cap (5); a seal gasket (6) being arranged inside a top of the housing cap (5);

the housing cap (5) having a head valve (12) arranged therein and a spring (11) disposed inside the head valve (12); the head valve (12) being arranged actively inside a valve passage formed by housing cap (5); the head valve (12) can move reciprocally along the valve passage in the housing cap (5); an inner O-ring (13) and an outer O-ring (14) respectively arranged at a bottom end of the head valve (12);

a collar (27) being actively arranged inside the cylinder seat (16), a cylinder (30) being disposed inside the cavity (311) of the tool body (31); an inner step surface being arranged at a top of the cylinder (30), which is used to limit the collar (27) at the lowest position; the collar (27) can move reciprocally along a space formed between the cylinder seat (16) and the inner step surface of the cylinder (30);

a control valve assembly (161) being arranged along a radial direction of the cylinder seat and having a control valve body (22) being movable in an inner hole arranged in a radial direction of the cylinder seat (16); the collar (27) having a groove disposed in an outer wall thereof and matched with a head part of the control valve body (22);

when the collar is moved to the highest position, the groove of the collar (27) is on the head part of the control valve body (22), at this point the control valve can be moved to the left; when the head part of the control valve body (22) is inserted into the groove of the collar (27), the control valve body is at the leftmost position, at this point a left air path is closed by the control valve body (22);

a piston driver assembly (28) being actively arranged inside a chamber formed by an inner hole of the collar (27) and an inner hole of the cylinder (30); the piston driver assembly (28) can move reciprocally along the inner wall of the collar (27) and cylinder (30);

a nose assembly (38) being connected fixedly to a bottom of the barrel and including a guide block (34) arranged at a top of the nose assembly (38), a piston stem of the piston driver assembly (28) actively arranged inside an inner hole of the guide block (34); when the piston driver assembly (28) is moving reciprocally along the inner wall of the collar (27) and cylinder (30), the piston stem of the piston driver assembly (28) is moving reciprocally along the inner hole of the guide block (34) simultaneously;

a chamber being formed between the nose assembly (38) and the guide block (34), in which an exhaust sleeve (36) is actively arranged, the guide block (34) being connected with the exhaust sleeve (36) through a spring (361); the exhaust sleeve (36) moving reciprocally inside the chamber; the nose assembly (38) having an exhaust hole (362) disposed thereon, the reciprocal movement of the exhaust sleeve (36) can control the opening and closing of the exhaust hole (362), so as to realize a lower part of the cylinder (30) is communicated with outside air through the nose assembly (38);

wherein the nose assembly (38) includes an exhaust passage disposed therein, one end of the exhaust passage communicated with a bottom of the left air passage of barrel, the other end of the exhaust passage communicated with a chamber formed between the nose assembly (38) and the guide block (34);

wherein the barrel includes a left air passage and a right air passage respectively arranged inside the barrel in a vertical direction, the right air passage having a trigger assembly arranged between the right air passage of barrel and a passage connected with outside air, which is used to control the communication between the right air passage of barrel and the outside air;

wherein the cylinder seat (16) includes a left air passage and a right air passage arranged therein, a bottom of the right air passage of the cylinder seat (16) communicated with a top of the right air passage of barrel, the left air passage of the cylinder seat (16) communicated with a top of the left air passage of barrel; the left pneumatic passage is formed by the left air passage of the cylinder seat (16) and the left air passage of barrel, while right pneumatic passage is formed by the right air passage of the cylinder seat (16) and the right air passage of barrel; the control valve assembly (161) of the cylinder seat (16) is used to control the left pneumatic passage opened and closed; when a pressure toward the right bigger than the left in the control valve assembly (161), the control valve body (22) moves to the left, and the left pneumatic passage is closed and vice versa; when the left pneumatic passage is opened, a bottom cavity of the head valve (12) is communicated therebetween;

wherein the housing cap includes an air passage of housing cap arranged therein, one end of the air passage of housing cap communicated with a top of valve passage of the housing cap (5), the other end of the air passage of housing cap communicated with the top of the right air passage of the cylinder seat (16).

2. The pneumatic nail gun according to claim 1, wherein the trigger assembly comprises a trigger valve head (56), a valve seat (46) connected fixedly with a top of the trigger valve head (56), a valve sleeve (50) arranged actively inside the valve seat (46), a plunger (53) connected with the valve sleeve (50) through a trigger spring (52); the plunger (53), the valve sleeve (50) and the trigger valve head (56) form a trigger valve head closed space; the plunger (53) extends out from the trigger valve head (56); the trigger valve head (56) includes a trigger valve head air passage disposed in a vertical direction; reciprocating movement of the plunger (53) can control the communication between the trigger valve head air passage and the trigger valve head closed space.

3. The pneumatic nail gun according to claim 1, wherein the cylinder (30) includes a bumper (32) arranged at a bottom thereof, which is used to reduce the impact force of the movement on the piston driver assembly (28); the bumper (32) is arranged on a top of the nose assembly (38).

4. The pneumatic nail gun according to claim 1, wherein the guide block (34) includes a resilient washer (33) arranged at a top thereof, which is used for axial positioning between the guide block (34) and the nose assembly (38).

5. A pneumatic nail gun according to claim 1, wherein the collar (27) is at the highest position in the beginning of operation; a compressed air entering the nail tool body from the air hose fitting (44) passes through the trigger assembly in an open state, and enters the top of the valve passage through the right air passage of the cylinder seat (16) and the air passage of the housing cap (5), which causes the head valve (12) to move downward until the outer O-ring (14) is connected with the cylinder seat (16), thereby forming a seal with an upper surface of the cylinder seat (16);

when the compressed air enters the cavity (311) of the tool body (31), the leftward pressure of the control valve assembly (161) is greater than the rightward pressure, the control valve body (22) moves to the left, the head part of the control valve body (22) is inserted into the groove of the collar (27) and forms a seal with a tilted surface of the cylinder seat (16), so that the left pneumatic passage is closed.

6. The pneumatic nail gun according to claim 1, wherein when the plunger (53) is moved downward, the plunger (53) drives the valve sleeve (50) to compress air disposed inside the trigger valve head closed space to increase its pressure and push the valve sleeve (50) upwardly, so that the air passage of the head valve (12) is communicated with the trigger valve head air passage; at this time, At this time, the leftward pressure of the control valve assembly (161) is zero and only subject to the right pressure, and the control valve body (22) moves to the right to open the left pneumatic passage;

when the compressed air arranged inside the cavity (311) of the tool body (31) enters the bottom cavity of the head valve (12) through the left air passage of the barrel and the left air passage of the cylinder seat, the head valve (12) is moved upward by the action of the compressed air until the top side of the head valve (12) contacts with the seal gasket (6) of the housing cap (5) to form a seal; at this point, the head valve (12) is separated from the cylinder seat (16), so as to open the air passage leading to an inner chamber of the cylinder (30);

the compressed air enters the inner chamber of the cylinder (30) from above the piston driver assembly (28) so that the piston assembly (28) is moved downwardly by pressure until a piston seat of the piston assembly is in contact with bumper (32); at the same time, the collar (27) also moves downwardly under differential pressure until collar (27) is in contact with the inner step of the cylinder (30) at lowest position.

7. The pneumatic nail gun according to claim 1, when wherein the plunger is released from the pressed position, the air passage of the head valve (12) is cut off from the outside air, the compressed air enters a top chamber of the head valve (12) through the air passage of the head valve (12), and the compressed air moves down the head valve (12) until upper surfaces of the head valve (12) and the cylinder seat (16) are formed with seals;

at this time, since the collar (27) is still at the lowest position, the head part of the control valve body (22) can not extend into the groove of the collar (27), the control valve body (22) can not move to the leftmost position under the restriction of the collar (27), so it can keep the left pneumatic passage open; the compressed air enters the top chamber of the head valve (12) through the air passage of the head valve (12), the compressed air is directed downwardly from the left air passage of the cylinder seat (16) through the left air passage of the barrel into the piston driver assembly (28) under the piston seat and into the chamber of the nose assembly (38) via the exhaust passage of the nose assembly (38); the compressed air entering the piston driver assembly (28) under the piston seat causes the piston driver assembly (28) to move upward; the compressed air entering the chamber of the nose assembly (38) lifts the exhaust sleeve (36) in the chamber upwardly, and the exhaust sleeve (36) closes the exhaust hole (362), thereby closing the passage of the lower part of the cylinder (30) through the nose assembly (38) in contact with the outside air;

when the piston driver assembly (28) is moved upwardly to contact with the collar (27) by the action of the compress air, the compressed air simultaneously urges the collar (27) to move upward together;

when the collar (37) is moved to the highest position, the collar (37) the control valve body (22) can move to the left, until the head part of the valve body (22) enters into the groove of the collar (27) for closed the left pneumatic passage; at this point, both the piston driver assembly (28) and the collar (27) are returned to original position;

as the left pneumatic passage is closed, the compressed air into chamber of the nose assembly is being blocked, the exhaust sleeve (36) moves downward by spring (361) for closed exhaust hole (362), so as to open the passage arranged in lower part of the cylinder (30) being communicated with outside air through the nose assembly (38) for exhausted the compressed air arranged in the chamber of the cylinder (30), thus, one cycle of operation is completed.

* * * * *